United States Patent [19]

Harris

[11] 3,964,695

[45] June 22, 1976

[54] TIME TO INTERCEPT MEASURING APPARATUS

[76] Inventor: James C. Harris, 2646 Albert Drive, Grand Rapids, Mich. 49506

[22] Filed: Oct. 10, 1974

[21] Appl. No.: 513,602

Related U.S. Application Data

[63] Continuation-in-part of Ser. No. 298,051, Oct. 16, 1972, abandoned.

[52] U.S. Cl. ..... 244/3.16; 244/3.13; 235/150.27; 343/112 CA

[51] Int. Cl.[2] ..... F41G 7/00; F42B 15/02; G06F 15/50

[58] Field of Search.... 343/112 CA, 112 D, 12 MD, 343/9; 235/150.26, 150.27, 151.32; 244/3.13, 3.16; 356/29

[56] References Cited

UNITED STATES PATENTS 3,698,811 10/1972 Weil ..... 244/3.13

*Primary Examiner*—Maynard R. Wilbur
*Assistant Examiner*—T. M. Blum

[57] ABSTRACT

An apparatus mounted in an intercept or seeker missile for computing during the flight of the intercept missile toward a target, such as another or target missile, a continuous estimate of the "time to go" to the point of closest approach of the intercept missile to the target and producing a control signal which varies in accordance with the "time to go" and which may be used for such purposes as arming a warhead of the intercept missile, controlling the navigational system of the intercept missile, and the like.

20 Claims, 9 Drawing Figures

TIME TO INTERCEPT MEASURING APPARATUS

This application is a continuation in part of application Ser. No. 298,051 now abandoned, Oct. 16, 1972 of JAMES C. HARRIS for TIME TO INTERCEPT MEASURING APPARATUS.

This invention relates to apparatus for computing time relationships between two bodies moving in predetermined paths relative to one another.

Intercept or seeker missiles used for intercepting targets, such as other missiles flying through the atmosphere or exoatmospheric space have radiation detecting sensors which detect radiation, either emanating or reflecting, from the target. The strength of the radiation detected by such sensor varies inversely as the distance or range from the source of radiation to the sensor and therefore to the intercept missile carrying the sensor. Since the target missile and the intercept missile move at very high speeds, many times the intercept missile will not actually collide with the target missile but will move past it. It is desirable, therefore, that the intercept target be provided with an apparatus for continuously estimating the time interval, i.e., "time-to-go", during the flight of the intercept missile in its intercept course with the target missile, between the instant position of the intercept missile and its point of closest approach to the target missile and for producing a control signal, which varies in accordance with the "time-to-go", which may be employed to arm the warhead of the intercept missile as the intercept missile approaches the point of closest approach and to cause the warhead to explode at some predetermined time interval so that the shrapnel produced by the explosion of the warhead will destroy or damage the target missle.

It may also be desirable to use the control signal of the apparatus in the navigational or directional system of the intercept missile to help steer the intercept missile more closely to the path of flight of the target.

Since the instantaneous intensity or strength of the radiation from the target missile detected by the sensor will vary with initial distance between the missiles; with atmospheric conditions; if reflected radiation is being sensed, with the nature of the reflective surface; and the like, it is also desirable that the output of the apparatus not be directly dependent on the instantaneous intensity of the received radiation.

Accordingly, it is an object of the invention to provide a new and improved apparatus for continuously computing the estimated "time-to-go" or time interval of travel of an intercept body or missile moving in a path intercepting the path of movement of a target to the point of closest approach of the intercept body to the target and for providing a control signal which varies in accordance with or represents such time interval.

Another object is to provide an apparatus for intercept missiles having a radiation sensor for detecting radiation emanating or reflecting from a moving target and providing an output signal which varies in accordance with the sensor output for computing the "time-to-go" of the intercept missile from its instant position to its point of closest approach to the target.

Still another object is to provide an apparatus, of the type described, wherein the apparatus includes means responsive to such output signal for continuously estimating the "time-to-go" until the senor output signal reaches its maximum or saturation value as the intercept missile approaches most closely the target missile and then utilizes the last presaturation value of the sensor output signal to continue to estimate the continuously decreasing "time-to-go."

Still another object is to provide an apparatus, of the type described, which is insensitive to such variable factors as the target reflectivity, cloudiness, intensity of the illumination of the target, and the like.

Additional objects and advantages of the invention will be readily apparent from the reading of the following description of an apparatus constructed in accordance with the invention, and reference to the accompanying drawings thereof, wherein.

Figure 1:
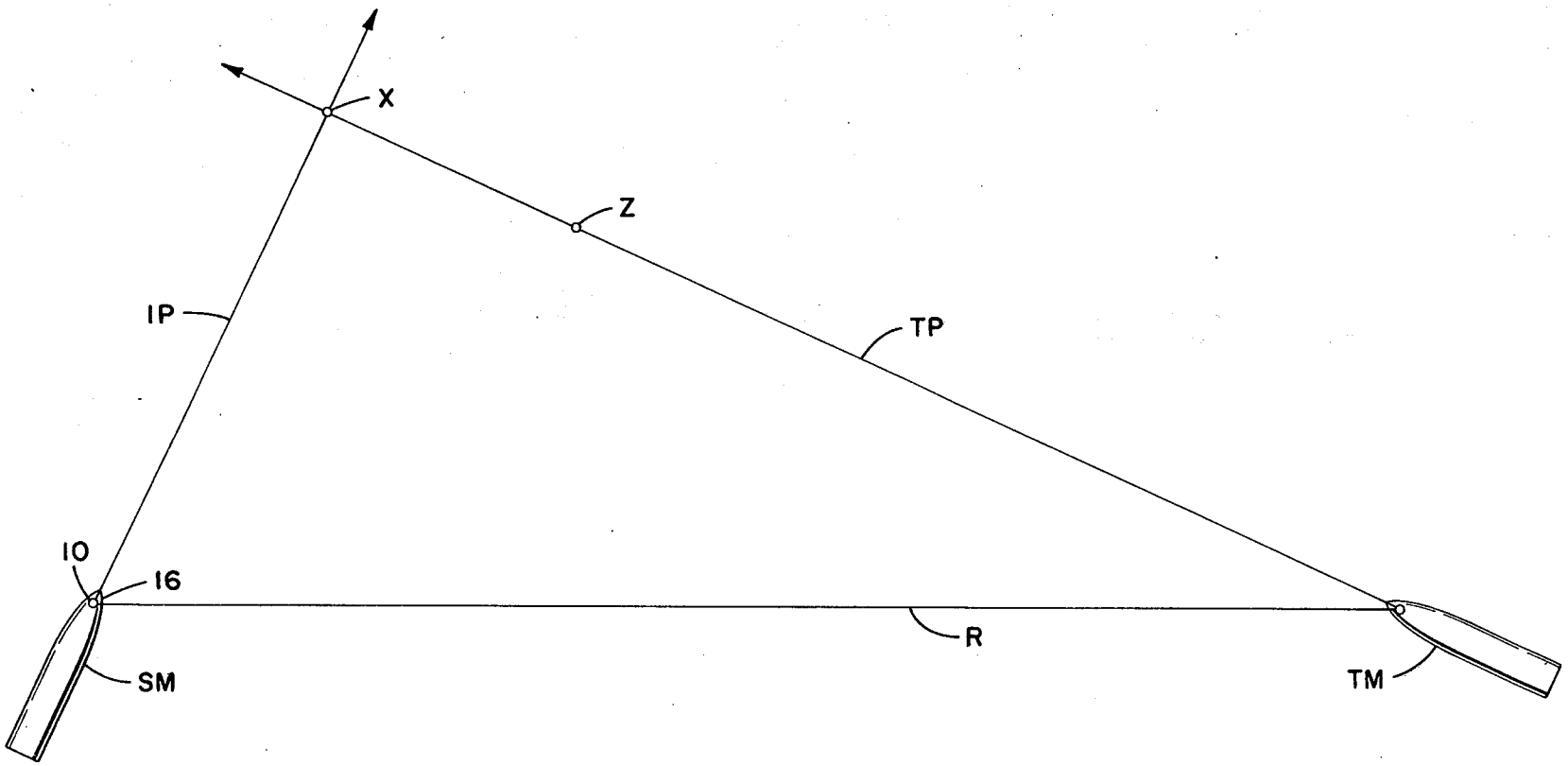
FIG. 1 is a diagrammatic illustration of the paths of travel of a target missile and an intercept or seeker missile.

Referring now to FIG. 1 of the drawing, the intensity of the radiation arriving at an intercept or seeker missile SM from a target missle TM varies inversely as the distance or range R therebetween. The seeker missile is, of course, programmed to travel in a path IP which will intercept the path TP of travel of the target missile, it being assumed that the velocities of the two missiles are substantially constant from the time of acquisition of the target missile by the detector system of the intercept missile. The seeker missile may not arrive at the intersection $x$ of these two paths at exactly the same time as the target missile and, indeed, the path of movement of the seeker missile may not actually intersect the path of movement of the target missile.

For example, the seeker missile may pass the point $x$ at the instant the target missile TM is at the point $z$ in its path of movement TP. In the case illustrated in FIG. 1, the location $x$ is the point of closest approach of the seeker missile to the target missile and the apparatus embodying the invention produces and output or control signal, as the seeker missile moves toward the point $x$ which represents, or varies in accordance with, the "time-to-go" or time interval of travel, at any instantaneous position of the seeker missile, to the point $x$.

Figure 2:
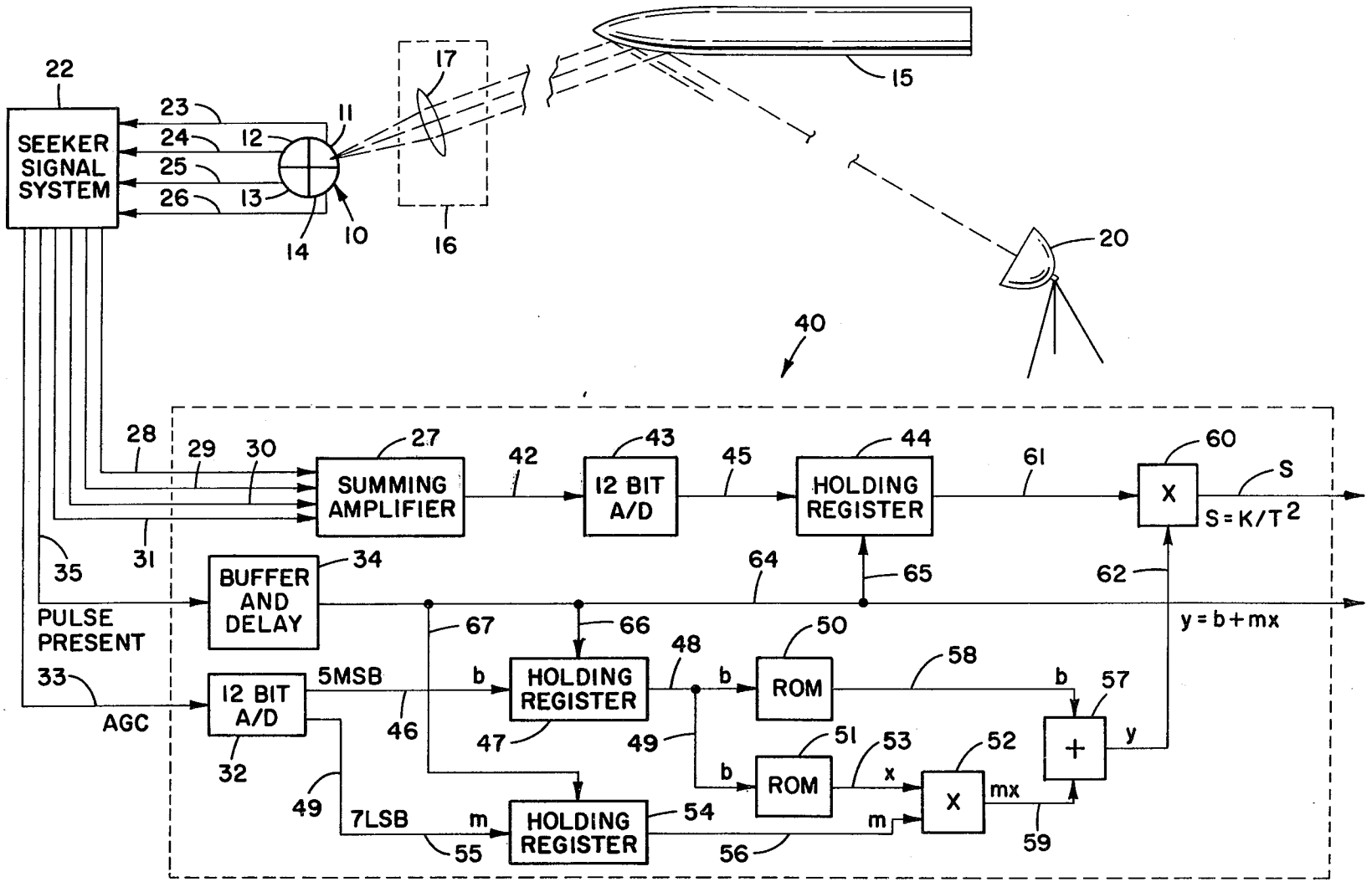
FIG. 2 is a block diagram of the interface equipment between the seeker missile signal system and the computer apparatus for estimating the "time-to-go"

Referring now to FIG. 2 of the drawings, the interceptor or seeker missile SM has mounted in the nose thereof a radiation detector means 10, such as four quadrant sensors 11, 12, 13, and 14 onto one of which, dependent on the axial orientation of the seeker missile relative to the target missile, is focused reflected radiation arriving from the target missile TM. The radiation is focused on the sensors by any suitable optical system 16 which may include a focusing lens 17.

The optical system may include suitable filters which permit only radiation of a predetermined wavelength to be transmitted to the sensors and the sensors themselves may be of the type which are responsive to radiation of a predetermined wavelength only.

The target missile is illuminated by trains of pulses, of predetermined frequency, of radiation of predetermined wavelength by ground equipment 20, with the radiation being produced by a laser of such ground equipment.

The sensors which may be any suitable type of photocell, provide a summed output signal S, which varies directly in accordance with the intensity of the radiation of the predetermined wavelength reflected from the target missile which intensity or strength varies inversely as the square of the range or distance between the target missile and the seeker missile, i.e., $S = K_1/R^2$ where $K_1$ is a constant and R is the range, and also $S = K/T^2$ where K is a second constant and T is the "time-to-go". The constant K assumes constant velocities of movement of the seeker and target missiles.

Figure 4:
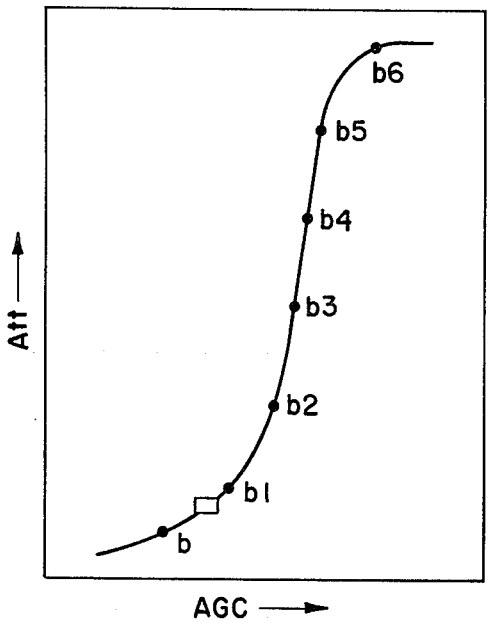
FIG. 4 is a graph showing the attenuation characteristics of an amplifier of the seeker missile signal system.

Since the magnitude of the output signals X of the sensors, as the intensity of received radiation increases as the seeker missile more closely approaches the target missile, will rise to excessive values, approaching infinity, the seeker signal system 22 of the seeker missile SM to which the signals from the sensors 11, 12, 13 and 14 are transmitted by the conductor means 23, 24, 25 and 26, respectively, is provided with an amplifier, not shown, which attenuates the received sensor signals in a predetermined manner, as illustrated in FIG. 4, before they are transmitted to a summing amplifier 27 by conductors 28, 29, 30, and 31, respectively. The seeker signal system also provides a gain control signal, AGC, which varies in accordance with the degree of attenuation of the sensor signals in the seeker signal system and which is transmitted to an analog-to-digital converter 32 by a conductor 33. The seeker signal system also transmits a "pulse present" signal to a buffer and delay register 34 through a conductor 35 whenever pulses of radiation of the predetermined wavelength are being detected by any one of the sensors 11–14.

Figure 2A:
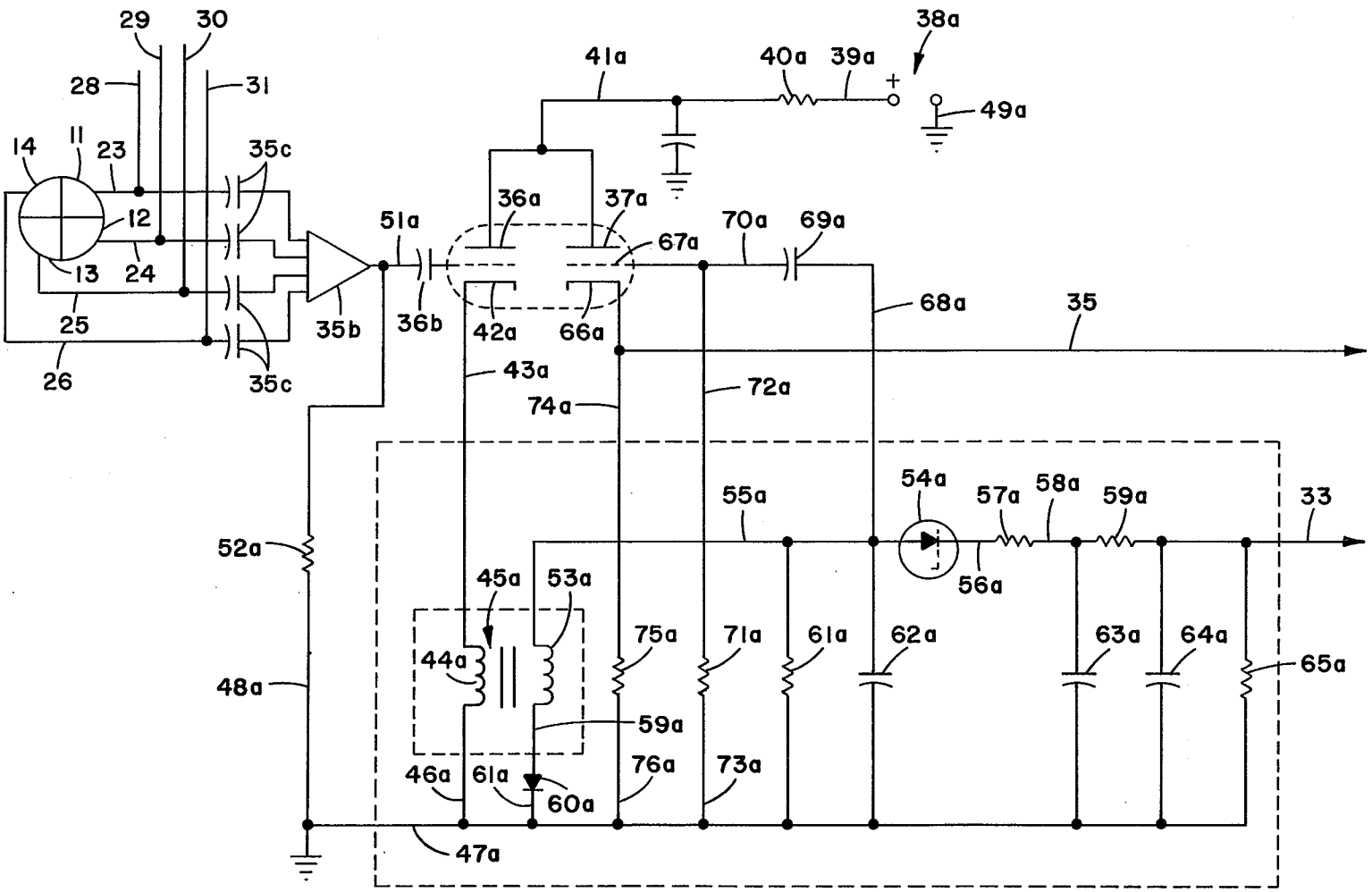
FIG. 2A is a schematic drawing of a circuit of the apparatus.

Referring now to FIG. 2A, the AGC and pulse present signals are provided by a circuit 34*a* which includes a double triode tube 34*a* to whose control grid 35*a* the output of an amplifier 35*b* is transmitted through a charging capacitor 36*b*. The output of the sensors 11–14 is transmitted to the amplifier 35*b* through blocking capacitors 35*c*. The anodes 36*a* and 37*a* are connected to the positive side of an input circuit 38*a* through a conductor 39*a*, a resistance 40*a* and a conductor 41*a*. The cathode 42*a* is connected to the opposite side of the input circuit 38*a* by a conductor 43*a*, the primary winding 44*a* of a transformer 45*a*, the conductors 46*a*, 47*a* and 48*a*, ground and the conductor 49*a*. Bias is provided to the control grid by means of the conductor 51*a*, a resistance 52*a* and the conductor 48*a* which connect the control grid 35*a* to ground.

The voltage induced in the secondary winding 43*a*, when current flows through the anode 36*a* - cathode 42*a* circuit of the tube 34*a*, is connected to the AGC signal conductor 33 by a circuit which includes a Zener diode 54*a*. The diode 54*a* is connected between one side of the secondary winding and the conductor 33 by conductors 55*a* and 56*a*, a resistance 57*a*, a conductor 58*a* and a resistance 59*a*.

The opposite side of the secondary winding 53*a* is connected to the conductor 47*a*, and therefore to ground, by a conductor 59*a*, a diode 60 and a conductor 61*a*. A filter network, which includes the resistance 61*a* and the capacitor 62*a* connected in parallel across the conductors 55*a* and 47*a*, is provided to bypass high frequency noise components.

The output of the rectifier diode 54 is smoothed by a filter network which includes a capacitor 63*a* connected between the conductors 58*a* and 47*a* and a capacitor 64*a* and a resistance 65*a* connected in parallel across the conductors 33 and 47*a*.

When the negative voltage across the resistance 61*a* exceeds a predetermined value, the Zener diode conducts and a negative voltage is transmitted to the conductor 33 which varies in accordance with the intensity of the radiation detected by the sensors 11–14.

The pulse present signal is provided by the side of the double triode tube 34*a* which includes the anode 37*a* and the cathode 66*a*, the output of the secondary winding 53*a* being transmitted to the control grid 67*a* by the conductors 55 and 68*a*, a capacitor 69*a* and the conductor 70*a*. A proper biasing potential is applied to the control grid 67*a* by a resistance 71*a* connected across the conductors 70*a* and 47*a* by the conductors 72*a* and 73*a*. The time delay provided by the charging capacitor 36*b* and a resistance 52*a* causes the pulse present signal to be produced as long as the sensors are detecting the radiation coming from the target.

The cathode 66*a* is connected to the conductor 47*a*, and therefore to ground, through the conductor 74*a*, a resistance 75*a* and the conductor 76*a*.

The output of the side of the double triode tube which includes the anode 37*a*, the cathode 66*a* and the control grid 67*a* is the pulse present signal and the conductor 35 is therefore connected to the conductor 74*a*.

The output of the sensing amplifier is also transmitted to the conductor 42 which is connected to the conductor 51*a*.

The circuit 40, illustrated in FIG. 2, restructures the outputs of the seeker signal system into digital data representing the $K/T^2$ relationship and is the interface equipment between the seeker signal system and the computer 41 which calculates the "time-to-go". The summing amplifier provides a signal which varies in accordance with the instantaneous sum of the attenuated signals from the sensors. The output data of the summing amplifier 27 is supplied, through conductor means 42, to an analog-to-digital converter 43 whose digital form output is transmitted to a holding register 44 by conductor means 45. The data in the holding register 44 represents the instantaneous sample and hold value of the summed attenuated output signals of the sensors 11–14 and must be corrected to represent the true non-attenuated value thereof.

The AGC signal is converted into binary data representing the correction factor y which is calculated using the formula $y = b + mx$ where $b$ is one of a number of predetermined points $b \ldots b_6$ on the AGC curve illustrated in FIG. 4, $x$ is the difference in value between two adjacent points on the curve, and $m$ is the fractional portion of such difference $x$ which must be added to a value represented by a point $b$ to obtain an accurate correction factor.

The AGC siganl is converted by the converter 32 into a 12 bit binary word with the five most significant bits of data thereof being transmitted through conductor means 46 to a holding register 47. the data in the holding register 47 is presented through conductor means 48 and 49 to a pair of "read only memories" 50 and 51, respectively. the five most significant bits of the word in the register 47 define the location of the next lowest point *b* on the AGC curve, FIG. 4, nearest the actual attenuation value of the summed sensor output signal then present in the holding register 44 while the seven least significant bits of the AGC word define the fractional portion of the difference *m* between such next lowest point *b* and the next higher point *b* at which lies the actual attenuation value. The read only memory 50 is used as a table lookup and contains data which identify the points $b - b_6$ on the AGC curve while the read only memory 51 contains data which define the differences *x*, which are the differences in value of *y* between adjacent points *b* of the AGC curve.

The multiplication of *m* by *x* is performed by multiplier 52, the data representing the value *x* being presented to the multiplier from the read only memory 51 through conductor means 53. The value *m* which is represented by the seven least significant bits is transmitted first to a holding register 54 through conductor means 55 and the data stored in the holding register 54 is presented to the multiplier 52 by conductor means 56. The data representing the product mx is then added to the data representing the next lowest point *b* on the AGC curve to obtain the actual correction factor *y* by an adder 57. The appropriate data from the read only memory 50, whose address in the read only memory 50 is determined by the five most significant bits of the binary word output of the converter 32, is transmitted to the adder by conductor means 58 and the binary word output of the multiplier 52 is transmitted to the adder 57 by conductor means 59.

The data in the holding register 44, representing the actual summed attenuated value of the outputs of the sensors 11–14, is then multiplied by the correction factor *y* by a multiplier 60 to which the data in the holding register 44 is presented through conductor means 61 and the data representing the correction factor *y* from the adder 57 is presented through conductor means 62. The output data of the multiplier now represents $K/T_2$ in binary word form.

The control circuit 40 operates only at times when the sensors are detecting the trains of pulses of radiation of the predetermined wavelength since only when the "pulse present" signal is transmitted from the seeker signal system to the buffer and delay register 34 are reset signals transmitted to the reset terminals of the registers 44, 47 and 54 by the conductor means 64 and 65, 64 and 66, and 64 and 67 respectively.

It will be apparent that binary word product produced by the multiplier 60 will change as the outputs of the sensors change at the times when a "pulse present" signal is received from the seeker signal circuit.

Figure 5:
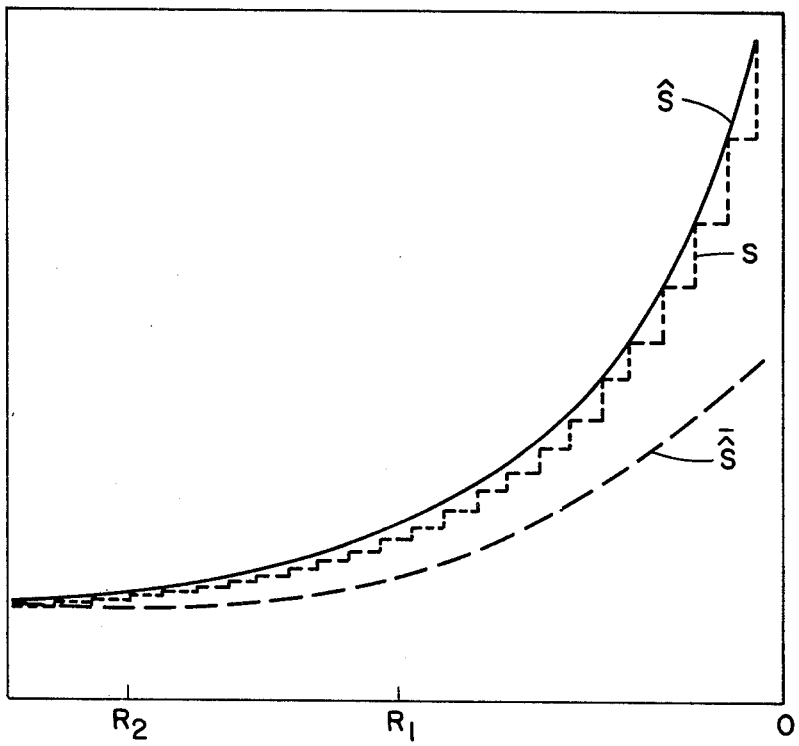
FIG. 5 is a graph showing the relationship of the instantaneous sensor output signal of the seeker signal system, the pulsed signal transmitted to the computer apparatus and the average signal strength.
Figure 4A:
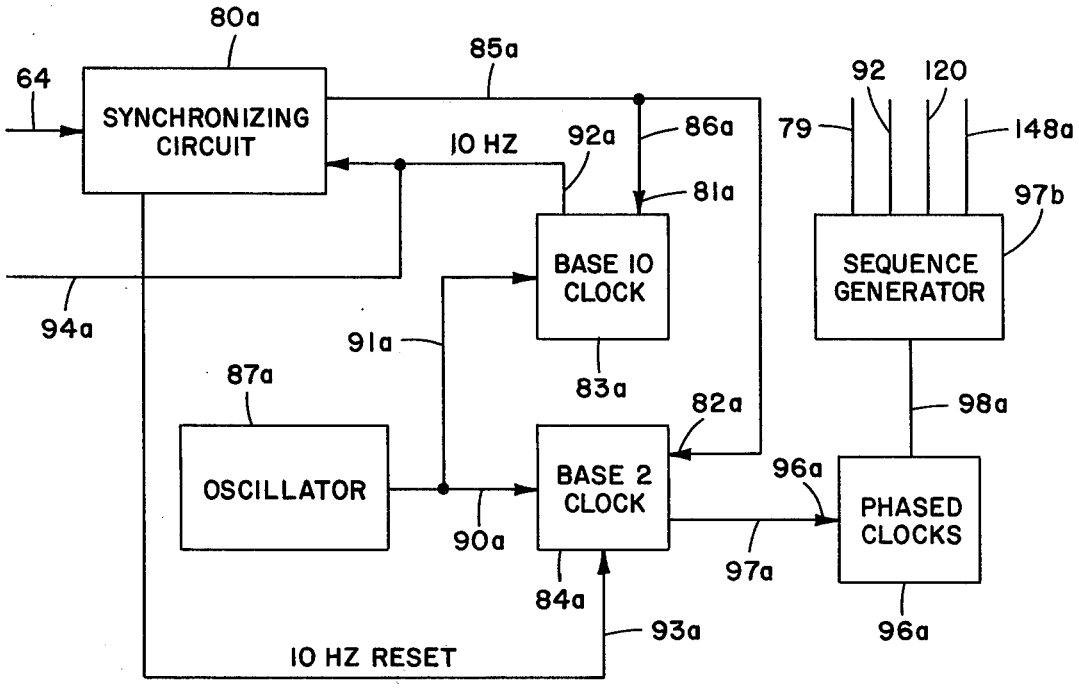
FIG. 4A is a block diagram of a portion of the apparatus.

Referring now to FIG. 5 of the drawings, the output of the interface equipment 40 which represents the value $S = K/T^2$ takes the form of the curve S, the instantaneous value of the estimated signal output of the sensors is represented by the curve $\hat{S}$, and the average estimated signal strength of the signal output of the sensors commencing with the instant of acquisition of the target missile as the range between the missiles decreases in represented by the curve $\bar{\hat{S}}$.

It will be apparent that the value of the average signal $\bar{\hat{S}}$ is substantially equal to the value of the instantaneous signal S at the time of acquisition by the seeker missile of the target missile at initial range and thereafter is of progressively lesser value than the value of the instantaneous signal although both increase as the range between the seeker missile and the target missile decreases. This relationship of the value of the average signal $\bar{\hat{S}}$ to the value of the instantaneous signal $\hat{S}$ permits accurate calculation of the estimated "time-to-go" $\hat{T}$ regardless of such conditions as target reflectivity and the intensity of illumination of the target, since the output of computer 41 is dependent only on this relation or ratio which initially is one to one at the instant of acquisition and decreases to substantially zero at the time of saturation of the sensors as the seeker missile most closely approaches the target missile and the instantaneous value approaches infinity.

Figure 3:
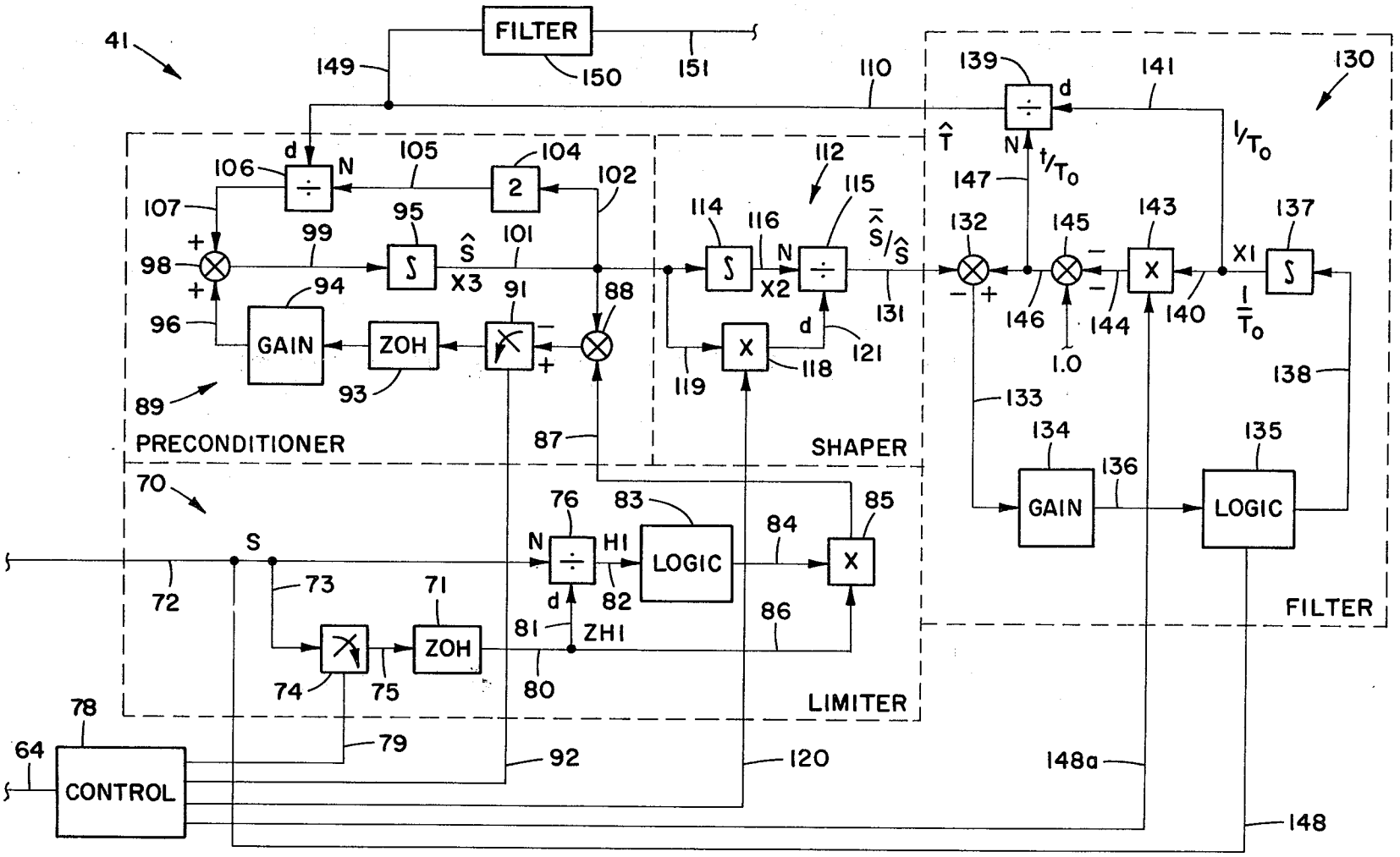
FIG. 3 is a block diagram of the computer apparatus.

Referring now particularly to FIG. 3 of the drawings, the computer 41 includes a limiter 70 whose function is to reduce the effects of noise and scintillation on the signal produced by the sensors 11–14 utilizing the knowledge that the value of each pulse of the predetermined radiation detected by the sensors 11–14 is received at a closer range than the preceding pulse and therefore should be stronger than the preceding pulse and that the increase in strength of each pulse cover that of the preceding pulse should not exceed a predetermined value, such predetermined value being determined by the relative velocities of the target missile and seeker missile and the range at which the seeker missile sensor saturates.

The binary data signal S from the multiplier 60 is presented to the "zero order hold" register 71 of the limiter through conductor means 72 and 73, a gate means 74 and conductor means 75 and to a divider 76 through the conductor means 72. The divider 76 divides the value of each pulse by the value of the preceding pulse, the binary data representing the value of such preceding pulse being in course stored in the register 71.

The operation of the gate means 74 is controlled by a control and timer circuit 78 which in turn is controlled by the pulse present signal transmitted thereto through conductor 64. The control circuit 78 transmits a control signal, through conductor means 79, to the gate means 74 to open the gate means at the appropriate times to shift the data representing the values of successive signal pulses.

The operation of the control and timer circuit 78 is controlled by the reset signals transmitted by the conductor 64 to a synchronizing circuit 80*a*. The synchronizing circuit transmits the pulse present reset signals to the input terminals 81*a* and 82*a* of clocks 83*a* and 84*a* through the conductors 85*a* and 86*a*.

The output of a high frequency oscillator 87*a* is transmitted to the input terminals 88*a* and 89*a* of the clocks 83*a* and 84 *a* by the conductors 90*a* and 91*a*.

The 10HZ output of the clock 83*a* is transmitted through the conductor 92*a* to the synchronizing circuit which in turn provides a 10HZ reset signal to the clock 84*a* by a conductor 93*a*. The 10HZ signal is also tranmsitted as clocking signals to other components of the circuitry, such as the converter 43*a*, by conductor means 94*a*.

The output of the clock 84*a* is transmitted to the input terminal of phased clocks 96*a* through a conductor 97*a*. The output of the phased clocks is transmitted to a sequence generator 97*b* by conductor means 98*a*.

The sequence generator in turn supplies the control signals to the conductors 79, 92, 120 and 148 in proper sequence and timing.

It will be apparent to those skilled in the art that the control and timer circuit is set in operation each time a pulse present reset signal is transmitted over the conductor 64 and that in response thereto, the clocks 83*a* and 84*a*, to which the output of the osciallator 87*a* is continuously supplied, are placed in proper timed operation to provide the appropriate timing and control signals to the various described elements of the apparatus.

The data in the register 71 is presented to the divider 76 through conductor means 80 and 81 and the data provided by the divider 76 is presented through the conductor means 82 to a logic circuit 83. The logic circuit, if the ratio of the value or strength of a pulse N + 1 is less than the value of the preceding pulse N, maintains the output of the shaper at the value of the preceding pulse N and if the value of the pulse N + 1 is greater than that of the pulse N, determines if the value of the pulse N + 1 over that of the pulse N is excessive. In this latter case also, the logic circuit maintains the value of the output of the shaper circuit some predetermined maximum value, such value being determined by the relative closing velocities of the seeker missile and the target missile and the range at which the seeker missile sensor saturates. Such decreases in the values of successive pulses or excessive increases in the values of successive pulse is of course caused by noise, scintillations, or other extraneous factors.

The data provided by the logic circuit 83 is presented through conductor means 84 to a multiplier 85 which multiplies the data in the register 71 which is presented to the multiplier 85 through conductor means 86.

It will be apparent that the logic circuit 83, if the value of the N + 1 pulse is less than that of the pulse N or is greater by excessive predetermined amount that the value of the pulse N, causes the multiplier 85 to multiply by one or the predetermined value respectively the value of the pulse N, the binary data representing the value of the pulse N being stored in the register 71. If the value of the pulse N + 1 meets the criteria determined by the logic circuit 83, the data then stored in the register 71 is multiplied by a factor greater than 1 causing the output of the multiplier 85 to be equal in value to the value of pulse N.

The output of the limiter 70 is transmitted through conductor means 87 to the summer means 88 of a preconditioner 89 which is a constrained Kalman filter. The input to the integrator 95 of the preconditioner 89 is the derivative of $K/T^2$ calculated as follows:

$$\frac{d(d/T^2)}{dt} = \frac{-2K}{T^3} = \frac{2K}{T(T^2)}$$

$$\frac{d(S)}{dt} = \frac{2}{T}\hat{S}$$

where $\hat{S}$ (FIG. 5) is the estimated continuous signal.

The operation of the preconditioner is controlled by the control and timer circuit 78 which provides a control signal to the gate means 91 of the preconditioner through conductor means 92. The preconditioner includes a "zero-order-hold" register 93, an electronic gain or amplifier 94 whose output is transmitted to an integrator 95 through conductor means 96, summer means 98 and conductor means 99. The feed back loop of the preconditioner means include conductor means 101 and 102, a times two multiplier 104 to which the output of the integrator 95 is transmitted by the conductor means 101, 102, conductor means 105, a divider 106, conductor means 107, the summer means 98 and conductor means 99.

The value of the estimated "time-to-go" (the output of the computer 41) is presented to the divider of the feed back loop of the preconditioner 89 by conductor means 110, the divider providing a signal representing the rate of change of the $K/T^2$ signal. The output of the divider is adjusted by the difference between the discrete $K/T^2$ signal of multiplier 85 and continuous or estimated $K/T^2$ signal out of integrator 95.

The output of the preconditioner is supplied to a shaper 112 which provides a signal equivalent to $\hat{S}/S$ or $1 - t/To$ by integrating the continuous $K/T^2$ out of integrator 95 multiplying the continuous $K/T^2$ by time ($t$) and dividing the results where To is the value of the time-to-go at the instant of initiation of operation of the apparatus or acquisition of the target missile. This calculation is as follows:

$$\int_{t=0}^{t=t} S\,dt = \int_{t=0}^{t=t} (K/T^2)\,dt = \frac{Kt}{TT_o} = \frac{KtT}{T^2T_o} = \frac{StT}{T_o}$$

$$\frac{\int_{t=0}^{t=t} S\,dt}{tS} = \frac{T}{T_o} = \frac{T_o - t}{T_o} = 1 - \frac{t}{T_o}$$

where To is the "time-to-go" at the instant of acquisition of the target missile.

The shaper includes an integrator 114 to which the output of the preconditioner is supplied by the conductor means 101 and whose output in turn is presented to a dvidier 115 by conductor means 116. The shaper also includes a multiplier 118 to which the output of the preconditioner is presented through the conductors 101 and 119. Time signals or pulses representative of time $t$, the time from the instant of initiation of operation of the apparatus, are transmitted to the multiplier from the control and timer circuit 78 through conductor means 120 and the product output of the multiplier is transmitted to the divider 115 by conductor means 121. The circuit 78 of course may include a suitable "clock", such as a multivibrator, which begins running at the instant the "pulse present"signal is received to provide the time signals or pulses.

The output of the shaper 112 is transmitted to a filter 130 through conductor means 131. The filter 130 is a constrained Kalman filter which models $1 - t/\hat{T}o$ to obtain $1/\hat{T}o$ and $\hat{T}/To$ which are divided to obtain T, the estimate of true "time-to-go."

The filter 130 includes a summer means 132 and conductor means 133 through which the error of the filter is transmitted to an electronic gain 134 whose output in turn is transmitted to a logic circuit 135 through conductor means 136. The logic circuit is employed to control the operation of an integrator 137, as will be explained below, to which the output of the logic circuit is transmitted by conductor means 138. The integrator 137 output is the value $1/\hat{T}o$ and is transmitted to the divider 139 by the conductor means 140 and 141. The integrator output $1/\hat{T}o$ is also multiplied by the time t by a multiplier 143 to provide the value $\hat{T}/\hat{T}o$ which is transmitted to the divider 139 through conductor means 144, a summer means 145 and conductor means 146 and 147. The filter 130 has a feed back loop which includes the conductor means 140, the multiplier 143, the conductor means 144, the summer means 145, the conductor means 146, and the summer means 132. The operation of the multiplier 143 and therefore of the filter 130 is controlled by the control means 78 which transmits appropriately timed pulses to the multiplier through the conductor means 148a.

The logic circuit 135 may be employed to control the operation of the computer 41 in several ways. For example, the logic circuit may set the input signal to the integrator 137 to zero if the "time-to-go" $\hat{T}o$ at the time of initial acquisition of the target by the sensors 11–14 is greater than a predetermined value and is increasing with time, or if the input to the integrator 137 is below a predetermined value and is decreasing with time. When the input to the integrator 137 is set to zero, the filter 130 acts as a reverse clock clocking down, as the timer pulses continue to be transmitted to the multiplier 143, from the value of $\hat{T}$ which existed at the time when the input signal to the integrator 137 was reduced to zero. In addition, the logic circuit 135 may also set to zero the input signal to the integrator when the outputs of the sensors 11–14 reach saturation value and as the reverse clocking continues, the accuracy of estimate of the "time-to-go" will be maintained as the "time-to-go" decreases. As a result the operation of the apparatus is not arrested when the range between the seeker and target missiles decreases to such small distance as to cause saturation of the sensors.

The signal indicative of the saturation condition of the sensors may be transmitted to the logic circuit 135 from the output conductor 72 of the interface equipment through conductor means 148.

The continuous data output of the divider 139 is $\hat{T}$, the true estimate of the "time-to-go" and is transmitted through the conductor means 110 and 149, and a suitable filter 150 to the output conductor means 151 of the apparatus and to the preconditioner 89 through the conductor means 110. The feedback loop of the preconditioner is updated during every sample period by the error between the pulsed input signal to the preconditioner from the limiter and the estimated rate of change of the $K/T_2$ signal.

In use, a prior knowledge of the sensor characteristics, velocities of the target and seeker missiles, intensity of illumination of the target missile and any other suitable factors is employed to program or set the logic circuits 83 and 135 to permit operation of the apparatus in a desired manner, as for example, to cause the limiter to permit transmittal of the signal S only if it falls within certain limits, to cause the signal input to the integrator to be set to zero when the sensors reach saturation condition, and the like.

The seeker missile is then placed in a path of movement programmed to intercept the path of movement of the target missile and the target missile is illuminated from the ground by trains of pulses of predetermined frequency of radiation of predetermined wavelength.

As the seeker missile moves in its intercept path of movement and such radiation is reflected from the target missile to the sensors of the seeker missile, the seeker missile signal system 22 produces sample and hold signals at predetermined intervals which vary in accordance with the outputs of the sensors and which are transmitted to the summing amplifier 27. Simultaneously the seeker missile signal system transmits the "pulse present" signal and the AGC signal to the interface equipment 40.

The binary data output signal, $S = K/T^2$, of the interface equipment is transmitted to the computer 41 and if the signal S is now in the proper range of values predetermined by the logic circuit 83 of the limiter, the computation of the estimated time-to-go is started in the manner described above.

The signal output at the output conductor means 151 now represents the estimated "time-to-go" and may be utilized for such functions as arming a warhead of the seeker missiles as the seeker missile begins to approach the target missile, causing the warhead to explode at the proper instant as the seeker missile approaches the target missile, and the like.

The computer apparatus 40 is employed in applications where the strength of the radiation detected by the sensor means varies inversely as the range squared from the seeker missile to the target missile as in the case where the radiation emanates from the target missile or where the target missile is illuminated with radiation of the desired wavelength from the ground. If the source of the radiation such as a laser is mounted in the intercept missile, however, the strength of the radiation detected by the sensor means will vary inversely as the range to the fourth power, i.e., $K/R^4$.

Figure 6:
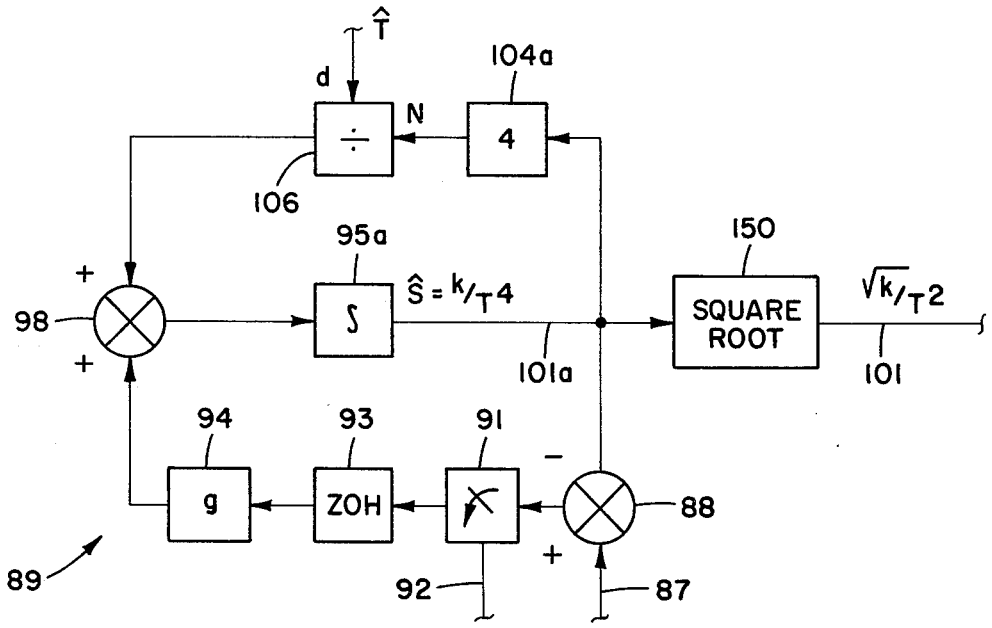
FIG. 6 is a block diagram of a modified form of a sub circuit of the computer apparatus illustrated in FIG. 3.

In this case the preconditioner 89 is modified as illustrated in FIG. 6 by changing the gain of the feed back loop from two to four by making the multiplier **104*a* multiply by four instead of by two. The integrator 95*a* then provides the output $\hat{S} = K/T^4$ which is transmitted to a logic circuit 150, through a conductor means 101*a*, which derives the square root of $K/T^4$, i.e., $\sqrt{K/T^2}$. The input to the shaper 112 is therefore of the same form as in the case of the computer illustrated in FIG. 3 and the output signal from the divider 139** will again be $\hat{T}$ or "time-to-go".

If the output signal of the seeker signal system varies inversely as the range between the seeker missile and the target missile, i.e., $K/R_1$ as would be the case wherein a radar type detector means were employed with the signal varying in accordance with the time intervals between emissions of pulses of radiation by a laser or microwave transmitter carried by the seeker missile and its reception by the sensor means after its reflection from the target missile.

Figure 7:
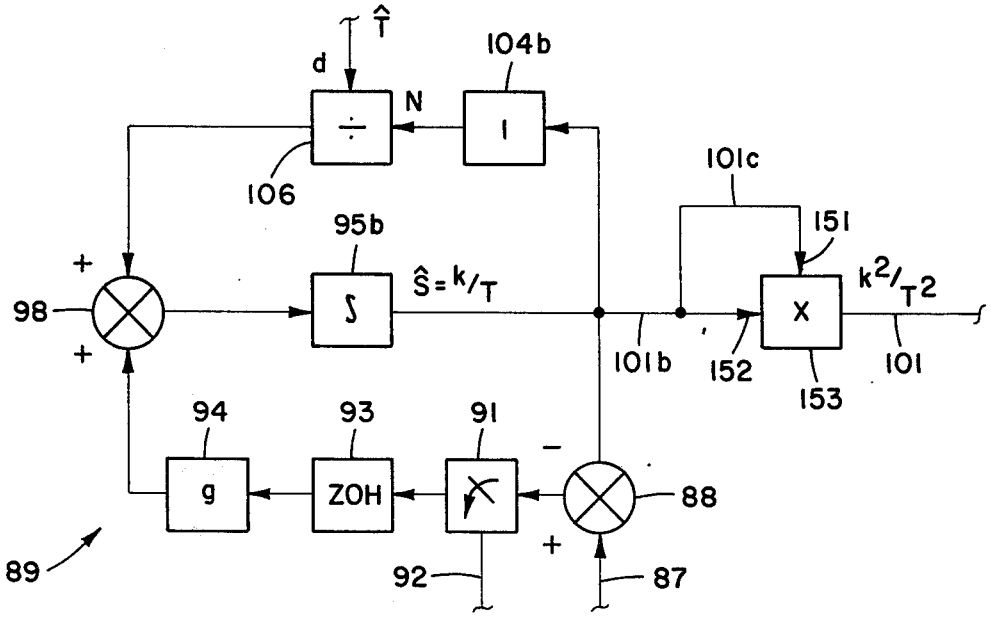
FIG. 7 is a block diagram of still another modified form of the sub circuit.

In this case, FIG. 7, the gain of the feed back loop of the preconditoner 89 would be changed to 1 by setting the multiplier **104*b* to multiply by 1 in which case the output of the integrator 95*b* would be $\hat{S} = K/T$ and would be transmitted to both input terminals 151 and 152 of a multiplier 153 through conductor means 101*b* and 101*c*. The output of the multiplier 153 would then again be of the form $K^2/T^2$ and be transmitted to the shaper 112 through the conductor means 101**.

The input to the shaper therefore again is of the same form as in the case of the computer illustrated in FIG. 3 and the output from the divider 139 will again be $\hat{T}$ or "time-to-go".

The apparatus embodying the invention has been illustrated and described in connection with missiles but it will be apparent that it may be used in other applications to determine the relationships between two moving bodies. For example, the apparatus may be used in transportation systems to prevent one vehicle from overtaking and colliding with a preceding vehicle. In this application when the "time-to-go" to instant of collision decreases to a predetermined value, the signal produced by the apparatus would be used to control the brake or drive means of the rear vehicle.

It will be seen that since the values of the instantaneous signal s, FIG. 5, and the average signal S initially are equal with the difference between such values increasing as the "time-to-go" decreases, the computer, utilizing the known rate of increase in this difference with the decrease in range between the missiles, produces a binary data signal or output at the output conductor means 151 which varies in accordance, and therefore indicates or represents, the "time-to-go."

It will be apparent to those skilled in the art that while the various conductor means of the system have been indicated by single lines, that each such line may represent a plurality of individual conductors.

While only one emobdiment of the invention, together with modifications therof, has been described in detail herein and shown in the accompanying drawing, it will be evident that various further modifications are possible in the arrangement and construction of its components without departing from the scope of the invention.

What is claimed is:

1. An apparatus for providing an output signal which varies in accordance with the time period from an instant position of a first body to the point of closest approach of the first body to a second body moving in paths to approach one another; said apparatus including:

sensor means on said first body for detecting radiation coming from the second body and providing a first signal which varies in accordance with a predetermined characteristic of the detected radiation; and first means responsive to said first signal for providing a second signal which varies in accordance with the ratio of the instantaneous value of said first signal to the average value of said first signal, from an initial instant of time when said values are substantially equal, during the movement of said bodies toward one another as the distance between said bodies decreases during their movement toward one another.

2. The apparatus of claim 1, and second means responsive to said second signal for producing a third signal which varies in accordance with the time interval of travel of said first body from an instant position to the position of its closest approach to said second body during their movement toward one another.

3. The apparatus of claim 2, wherein said first means includes limiter means for transmitting successive sensor means signals having predetermined relation to preceding sensor means signals.

4. The apparatus of claim 3, wherein said limiter means include means for preventing transmission of sensor means signals of decreasing value and of excessively increasing values.

5. The apparatus of claim 4, wherein said second means includes means for continuously estimating the decreasing time interval after the sensor means signal attains a saturation value as said bodies approach one another.

6. The apparatus of claim 5, wherein said first signal is an analog signal, and said first means includes means for providing a first digital data signal which varies in accordance with said analog signal.

7. The apparatus of claim 6, wherein said first means includes limiter means, said first digital data signal being transmitted to said limiter means, third means responsive to the output of said limiter means for producing a second digital data signal which varies in accordance with the instantaneous values of said first digital signals, said limiter means transmitting said first digital data signals having predetermined relation to preceding first digital data signals.

8. The apparatus of claim 7, wherein said first means includes fourth means responsive to said second digital data signals and the time from said initial instant of time for providing third digital data signals varying in accordance with the relation of the average value of said sensor means signals from said initial instant of time to the instantaneous value of said sensor means signals.

9. The apparatus of claim 8, wherein said first means includes fifth means responsive to said third signals for producing a fourth signal which varies in accordance with the time interval of travel of said third body from an instant position to the position of its closest approach to said second body during their movement toward one another.

10. The apparatus of claim 9, wherein said characteristic of the detected radiation is its intensity and said first signal varies in accordance with the inverse of the square of the range from said first body to said second body.

11. The apparatus of claim 1, wherein said characteristic of the detected radiation is its intensity and said first signal varies in accordance with the inverse of the square of the range from said first body to said second body.

12. The apparatus of claim 11, and second means responsive to said second signal for producing a third signal which varies in accordance with the time interval of travel of said first body from an instant position to the position of its closest approach to said second body during their movement toward one another.

13. The apparatus of claim 12, wherein said first means includes limiter means for transmitting successive sensor means signals having predetermined relation to preceding sensor means signals.

14. The apparatus of claim 13, wherein said limiter means include means for preventing transmission of sensor means signals of decreasing value and of excessively increasing values.

15. The apparatus of claim 14, wherein said second means includes means for continuously estimating the decreasing time interval after the sensor means signal attains a saturation value as said bodies approach one another.

16. The apparatus of claim 15, wherein said first signal is an analog signal, and said first means includes means for providing a first digital data signal which varies in accordance with said analog signal.

17. The apparatus of claim 16, wherein said first means includes limiter means, said first digital data signal being transmitted to said limiter means, third means responsive to the output of said limiter means for producing a second digital data signal which varies in accordance with the instantaneous values of said first digital signals, said limiter means transmitting said first digital data signals having predetermined relation to preceding first digital data signals.

18. The apparatus of claim 17, wherein said first means includes fourth means responsive to said second digital data signals and the time from said initial instant of time for providing third digital data signals varying in accordance with the relation of the average value of said sensor means signals from said initial instant of time to the instantaneous value of said sensor means signals.

19. The apparatus of claim 1, wherein said first signal is an analog signal and third means including converter means for providing a first digital data signal which varies in accordance with said analog signal.

20. The apparatus of claim 19, wherein said sensor means has associated therewith an amplifier for attenuating said first signal and control means providing a further signal which varies in accordance with the degree of attenuation of said first signal.

* * * * *